United States Patent [19]

Zinnbauer

[11] 3,984,028

[45] Oct. 5, 1976

[54] CONTAINER HINGE CONSTRUCTION

[75] Inventor: Gerald Boyd Zinnbauer, Carmel, Ind.

[73] Assignee: Eli Lilly and Company, Indianapolis, Ind.

[22] Filed: Jan. 26, 1976

[21] Appl. No.: 652,030

[52] U.S. Cl. ..... 220/338; 220/337; 16/169

[51] Int. Cl.[2] ..... B65D 43/14; B65D 51/04

[58] Field of Search ..... 220/337, 338, 306; 16/168–169

[56] References Cited

UNITED STATES PATENTS

| | | | |
|---|---|---|---|
| 2,627,995 | 2/1953 | Waterman | 220/338 |
| 2,905,356 | 9/1959 | Jerome | 220/337 X |
| 3,055,534 | 9/1962 | Boenecke | 220/338 |
| 3,333,726 | 8/1967 | Belanger | 220/337 |

*Primary Examiner*—George T. Hall
*Attorney, Agent, or Firm*—Houston L. Swenson; Everet F. Smith

[57] ABSTRACT

A hinge construction for a two-sectioned container in which the hinge includes a pintle mounted on a relatively flexible wall surface of one of the container's sections and is seated within a recessed socket of the other container section to provide a hinged container which, when closed, substantially conceals the elements of the hinge construction.

5 Claims, 6 Drawing Figures

CONTAINER HINGE CONSTRUCTION

BACKGROUND OF THE INVENTION

Plastic boxes have been injection molded from various plastic materials such as polystyrene for a number of years. Most of these boxes have used rectangular covers that couple to rectangular receptacles by means of ball and socket hinges. These hinges have basically comprised the use of a ball element extending from the outer edge of one container section and a pair of spaced projections extending from the other container section which serves to straddle the ball and act as a socket. In assembling containers of this design the two projections forming the socket of the hinge are temporarily flexed outwardly from each other as the ball of the hinge is forced therebetween. The protrusion of these hinge elements has generally been acceptable but in certain instances such as in cosmetic products, it is desirable to provide a container with a more aesthetic appearance. Such containers have eliminated some of the undesirable features of the conventional ball and socket hinge by providing for apertures in one or more areas of a container's section for receiving pintles. However, since these hinge constructions still require temporary flexing of walls during the assembly of the hinge it has been necessary to provide a container with relatively thin walls. Thus, the thin walls will temporarily flex as the container sections are forcibly assembled. This limitation has prohibited the use of exceptionally heavy or thick wall sections and has likewise limited the amount of sculpturing that can be produced on the walls of the containers.

SUMMARY OF THE INVENTION

The novel hinge construction of my invention permits the use of relatively thick and rigid side walls of both container sections. This hinge construction is integral to the container sections and calls for only conventional injection molding techniques. The hinge comprises a recessed socket that is formed in the internal surface of the receptacle cover's side wall and a pintle that is formed on a corresponding exterior surface of the container receptacle's side wall. The pintle is of general cylindrical configuration and extends outwardly from a leaf spring that forms a part of the receptacle's side wall. This leaf spring, which is formed with a large portion of its perimeter spaced from the adjacent side wall material, may be flexed inwardly as the pintle on the container cover is forced downwardly over the receptacle. In this manner a container of unique appearance is provided inasmuch as the container, in its normal upright position, shows no evidence of a hinge when closed and has no interior elements that would interfere with the contents of the container.

DESCRIPTION OF THE PREFERRED EMBODIMENT

Figure 1:
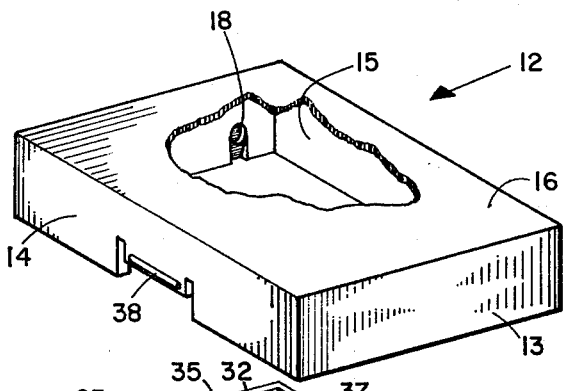
FIG. 1 is a perspective view of a container cover with a portion removed to disclose the interior socket.
Figure 5:
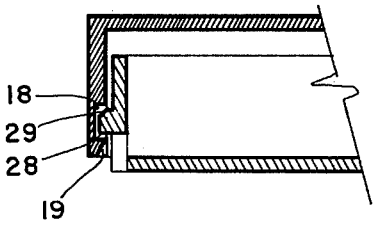
FIG. 5 is a partial view of the assembled container taken along line 5—5 of FIG. 3.
Figure 6:
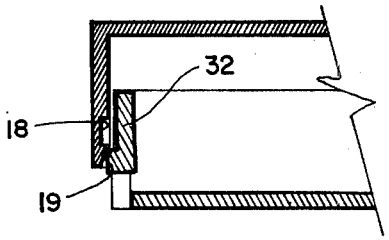
FIG. 6 is a partial view in cross section illustrating the hinge flexing action as it is being assembled.

The plastic container of this invention is illustrated in a rectangular form. However, it is to be understood that the hinge construction of my invention is applicable to other configurations with particularly thick walls. Referring to FIG. 1, a cover 12 is illustrated which is formed of a plastic material. Cover 12 has a pair of side walls 13, a front wall 14 and a rear wall 15. These walls are relatively thick and are not readily flexible. The cover is completed with a top wall 16. A hinge socket is formed in the internal surface and lower half of a cover side wall 13 comprising a recessed surface 18 of cylindrical configuration. It is to be noted that this socket preferably does not extend through the full thickness of the side wall as illustrated in FIGS. 5 and 6. Socket 18 has a lead-in ramp 19 which extends on an outwardly inclined plane to the edge of the side wall. A similar socket may be formed on the internal surface of the opposite side wall 13 and likewise spaced from rear wall 15.

Figure 2:
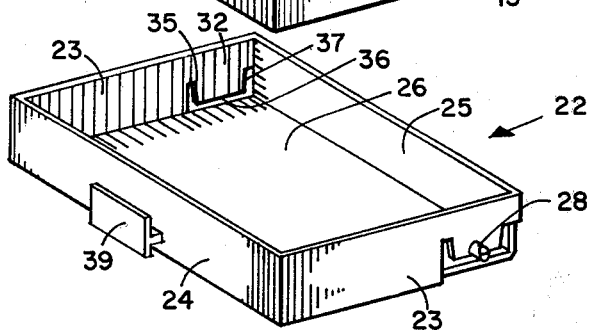
FIG. 2 is a perspective view of the container receptacle.
Figure 3:
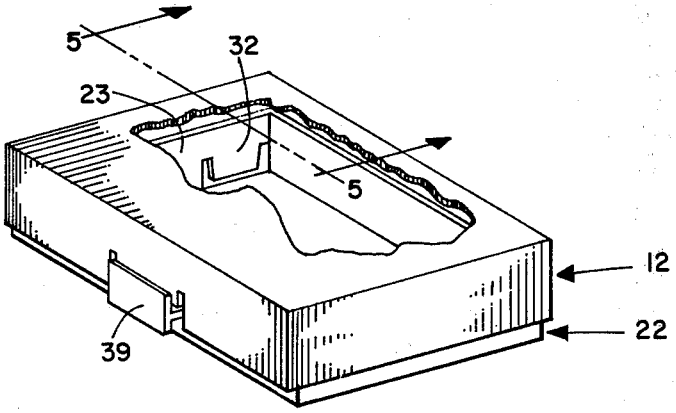
FIG. 3 is a perspective view of the container sections assembled with a portion removed to illustrate the interior hinge.
Figure 4:
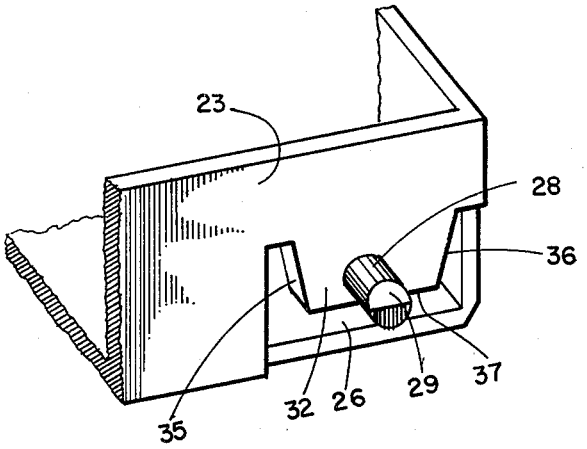
FIG. 4 is an enlarged perspective view of the hinge pintle.

The container receptacle 22 is of corresponding rectangular configuration as shown in FIG. 2. It comprises a pair of like side walls 23, a front wall 24, a rear wall 25 and a bottom wall 26. Referring to FIGS. 2 and 4, pintle 28 of my hinge construction is of substantially cylindrical configuration and extends outwardly from the exterior surface of receptacle side wall 23. An inclined portion 29 on the end of the pintle is provided for sliding across ramp 19 on the receptacle cover. A portion of the receptacle side wall 23 has been formed to provide a flexible tongue element comprising a leaf spring 32. This spring has three free edges, 35, 36 and 37, which are spaced from the adjacent walls 23, 25 and 26. Thus, the pintle 28 is free to flex inwardly by a distance sufficient to clear ramp 19. A similar pintle construction is formed on the opposite receptacle side wall.

In assembling the container embodying my invention it is to be noted that cover 12 has walls that are slightly larger than the corresponding walls of the receptacle to enable it to closely telescope over the receptacle. Referring to FIG. 6, side walls 13 are positioned to envelop the side walls 23 of the receptacle. The inclined surface 29 of pintle 28 will engage ramp 19 on the lowermost edge of the cover side wall. As the cover continues to be pushed downwardly over the receptacle the leaf spring 32 supporting the pintle is flexed inwardly. This flexing will continue until the cover is in its fully assembled position of FIG. 5 whereby pintle 28 is permitted to snap into the recessed socket 18. Once both pintles are in their positions within their respective sockets the cover becomes fully hinged to the receptacle and may be freely opened without becoming disengaged.

If desired, a latch may be provided on the container and in the particular illustration comprises a projecting strip 38 on the cover's front exterior wall that couples with a latch element 39 on the front exterior wall of the receptacle. In opening the container it is apparent that the cover may be positioned to stay open on a rearward inclined plane when the receptacle is on a flat surface inasmuch as the rear wall 15 of the cover will abut the stationary surface.

Thus, this hinge construction enables one to design a container that is completely free of exterior hinge elements as well as utilizing substantially thick walls for structural stability which afford the opportunity to sculpture the walls of more ornamental designs of boxes.

I claim:

1. In a container having a cover with rigid side walls enveloping the rigid side walls of a receptacle, an integral hinge construction coupling the cover and receptacle comprising a recessed socket formed in the internal surface and lower half of a cover side wall, and a pintle integrally formed on a corresponding exterior surface and lower half of a receptacle side wall, said pintle being of cylindrical configuration and extending outwardly from a leaf spring forming a part of the receptacle side wall.

2. A hinge construction in accordance with claim 1 in which the lower internal edge of the cover and the upper edge of said pintle have complementary inclined surfaces which are in contact with each other only during assembly of said pintle into said socket.

3. A hinge construction in accordance with claim 2 in which said leaf spring is freely spaced on three edges from its adjacent receptacle walls for temporary inward flexing during assembly of said cover and receptacle.

4. A hinge construction in accordance with claim 3 in which said inclined surface on said cover's internal surface extends from said socket to the edge of said side wall.

5. A hinge construction in accordance with claim 4 in which said inclined surface on said pintle is on the upper half of the pintle's end.

* * * * *